US011794962B2

(12) United States Patent
Desjardins

(10) Patent No.: US 11,794,962 B2
(45) Date of Patent: Oct. 24, 2023

(54) BOTTLE CAP ASSEMBLY

(71) Applicant: ROY + LECLAIR EMBALLAGE INC., Pintendre (CA)

(72) Inventor: Serge Desjardins, Hudson (CA)

(73) Assignee: ROY + LECLAIR EMBALLAGE INC., Pintendre (CA)

( * ) Notice: Subject to any disclaimer, the term of this patent is extended or adjusted under 35 U.S.C. 154(b) by 455 days.

(21) Appl. No.: 17/048,217

(22) PCT Filed: Apr. 18, 2019

(86) PCT No.: PCT/CA2019/050490
§ 371 (c)(1),
(2) Date: Oct. 16, 2020

(87) PCT Pub. No.: WO2019/200486
PCT Pub. Date: Oct. 24, 2019

(65) Prior Publication Data

US 2021/0086964 A1 Mar. 25, 2021

Related U.S. Application Data

(60) Provisional application No. 62/725,293, filed on Aug. 31, 2018, provisional application No. 62/660,344, filed on Apr. 20, 2018.

(51) Int. Cl.
*B65D 50/06* (2006.01)
*B65D 41/18* (2006.01)
(Continued)

(52) U.S. Cl.
CPC ..... *B65D 50/046* (2013.01); *B65D 41/185* (2013.01); *B65D 41/0471* (2013.01); *B65D 2203/12* (2013.01); *B65D 2215/02* (2013.01)

(58) Field of Classification Search
CPC ..... B65D 50/046; B65D 50/02; B65D 50/04; B65D 50/045; B65D 50/061; B65D 50/066; B65D 41/18; B65D 41/16; B65D 41/165; B65D 41/185; B65D 41/48; B65D 2215/00; B65D 2215/02; B65D 2215/04; B65D 2543/00925; B65D 2543/0062; B65D 2543/00694; B65D 2543/00712; B65D 2543/00722; B65D 2543/00731; B65D 2543/0074; B65D 2543/0075;
(Continued)

(56) References Cited

U.S. PATENT DOCUMENTS 3,376,991 A * 4/1968 Deaver ..... B65D 50/046 215/217
3,980,194 A * 9/1976 Costa ..... B65D 50/061 215/206
(Continued)

FOREIGN PATENT DOCUMENTS

GB 1404308 A * 8/1975 ..... B65D 41/185
WO 199610522 4/1996

*Primary Examiner* — Allan D Stevens
(74) *Attorney, Agent, or Firm* — Reno Lessard; Norton Rose Fulbright Canada LLP

(57) ABSTRACT

There are described bottle cap assemblies. In some embodiments, a bottle cap assembly includes a cap which is snappingly engagable to a bottle and disengageable by rotating the cap and the bottle relative to one another, squeezing the cap suitably and pulling the cap away from the bottle.

14 Claims, 13 Drawing Sheets

(51) Int. Cl.
*B65D 50/04* (2006.01)
*B65D 41/04* (2006.01)

(58) Field of Classification Search
CPC ..... B65D 2543/00759; B65D 2543/00768; B65D 2543/00777; B65D 2543/00787; B65D 2543/00796; B65D 2543/00805; B65D 2543/00814; B65D 2543/00592
See application file for complete search history.

(56) References Cited

U.S. PATENT DOCUMENTS

| | | | | | |
|---|---|---|---|---|---|
| 4,588,097 | A * | 5/1986 | Hauser | B65D 50/045 | 215/216 |
| 4,613,063 | A * | 9/1986 | Wright | B65D 55/02 | 222/548 |
| 5,230,433 | A | 7/1993 | Hamilton et al. | | |
| 5,836,466 | A * | 11/1998 | Briere | B65D 50/046 | 215/217 |
| 5,908,125 | A | 6/1999 | Opresco | | |
| 6,854,613 | B2 * | 2/2005 | Biesecker | B65D 50/046 | 215/218 |
| 7,975,862 | B2 * | 7/2011 | Gnepper | B65D 47/265 | 215/230 |
| 9,181,000 | B2 | 11/2015 | Yoshida et al. | | |
| 2004/0222181 | A1 * | 11/2004 | Biesecker | B65D 50/046 | 215/218 |

* cited by examiner

BOTTLE CAP ASSEMBLY

FIELD

The improvements generally relate to bottle cap assemblies and more specifically relate to bottle cap assemblies including a snap engagement between the bottle and the cap.

BACKGROUND

Existing bottle cap assemblies can be found in various forms. However, not all the bottle cap assemblies are child-resistant and/or elder-friendly. Although the existing bottle cap assemblies have been found to be satisfactory to a certain degree, there remains room for improvement.

SUMMARY

There are described bottle cap assemblies which can be used to carry and deliver a fluid such as a nasal spray fluid and the like. Each bottle cap assembly has a cap which can be engaged to and disengaged from a bottle. The engagement between the cap and the bottle is preferably child-resistant and/or elder-friendly and also tough enough to prevent accidental disengagement of the cap, which can lead to undesirable fluid loss.

In one aspect, the bottle has a base and a wall axially extending from a periphery of the base and leading to a neck finish. The neck finish has two circumferentially spaced-apart shoulders protruding from an exterior circumference of the neck finish, and two circumferentially spaced-apart grooves recessing from the exterior circumference. The two grooves are axially closer to the base than the two shoulders. Each groove is circumferentially aligned with a corresponding one of the two shoulders so as to define two diametrically opposite slots around the exterior circumference.

In this aspect, the cap has a top, a wall axially extending from a periphery of the top and leading to a circular contour. The cap has first and second snap engagement means protruding inwardly from an interior circumference of the wall in proximity to the circular contour where the first snap engagement means has a first radial protrusion length. The second snap engagement means have at least two snap engagement members being diametrically opposite to one another around the interior circumference. The two snap engagement members have a second radial protrusion length exceeding the first protrusion length.

As will be described below, the cap can be snappingly engaged to the bottle by forcing the first and second snap engagement means of the cap over the two shoulders so as to snugly secure at least the first snap engagement means in the grooves of the bottle. The cap can be disengaged from the bottle by squeezing the cap at two diametrically opposite points corresponding to the two diametrically opposite slots of the bottle thereby deforming the circular contour into an ovoid contour, which can allow the first and second snap engagement means to be unsecured from the grooves of the bottle which can thereafter allow pulling of the cap away from bottle.

In accordance with one aspect, there is provided a bottle cap assembly comprising: a bottle having a base and a wall axially extending from a periphery of the base and leading to a neck finish, the neck finish having at least two circumferentially spaced-apart shoulders protruding from an exterior circumference of the neck finish, and at least two circumferentially spaced-apart grooves recessing from the exterior circumference, the grooves being axially closer to the base than the shoulders, each groove being circumferentially aligned with a corresponding one of the shoulders so as to define at least two diametrically opposite slots around the exterior circumference; and a cap having a top and a wall axially extending from a periphery of the top and leading to a circular contour, the cap having first and second snap engagement means protruding inwardly from an interior circumference of the wall in proximity to the circular contour, the first snap engagement means having a first radial protrusion length, the second snap engagement means having at least two snap engagement members being diametrically opposite to one another around the interior circumference, the at least two snap engagement members having a second radial protrusion length exceeding the first protrusion length, the cap being snappingly engageable to the bottle by forcing the first and second snap engagement means of the cap over the shoulders so as to secure at least the first snap engagement means in the grooves of the bottle, and the cap being disengageable from the bottle by squeezing the cap at at least two diametrically opposite points corresponding to the slots of the bottle thereby deforming the circular contour into an ovoid contour allowing the first and second snap engagement means to be unsecured from the grooves of the bottle which thereafter allows pulling the cap away from bottle.

In accordance with another aspect, there is provided a method of disengaging a cap from a bottle, the bottle having a base and a wall axially extending from a periphery of the base and leading to a neck finish, the neck finish having at least two circumferentially spaced-apart shoulders protruding from an exterior circumference of the neck finish, and at least two circumferentially spaced-apart grooves recessing from the exterior circumference, the grooves being axially closer to the base than the shoulders, each groove being circumferentially aligned with a corresponding one of the shoulders so as to define at least two diametrically opposite slots around the exterior circumference; and the cap having a top and a wall axially extending from a periphery of the top and leading to a circular contour, the cap having first and second snap engagement means protruding inwardly from an interior circumference of the wall in proximity to the circular contour, the first snap engagement means having a first radial protrusion length, the second snap engagement means having at least two snap engagement members being diametrically opposite to one another around the interior circumference, the at least two snap engagement members having a second radial protrusion length exceeding the first protrusion length, the method comprising: squeezing the cap at at least two diametrically opposite points corresponding to the slots of the bottle thereby deforming the circular contour into an ovoid contour allowing the first and second snap engagement means to be unsecured from the grooves of the bottle; and pulling the cap away from bottle.

In accordance with another aspect, there is provided a bottle cap assembly comprising: a bottle having a base and a wall axially extending from a periphery of the base and leading to a neck finish, the neck finish having at least one circumferentially extending shoulder protruding from an exterior circumference of the neck finish, and at least one circumferentially extending grooves recessing from the exterior circumference, the at least one groove being axially closer to the base than the at least one shoulder, each of the at least one groove being circumferentially aligned with a corresponding one of the at least one shoulder so as to define at least one slot around the exterior circumference; and a cap having a top and a wall axially extending from a periphery of the top and leading to a circular contour, the cap having first and second snap engagement means protruding inwardly from an interior circumference of the wall in proximity to the circular contour, the first snap engagement means having a first radial protrusion length, the second snap engagement means having at least two snap engagement members being diametrically opposite to one another around the interior circumference, the at least two snap engagement members having a second radial protrusion length exceeding the first protrusion length, the cap being snappingly engageable to the bottle by forcing the first and second snap engagement means of the cap over the at least one shoulder so as to secure at least the first snap engagement means in the at least one groove of the bottle, and the cap being disengageable from the bottle by squeezing the cap at two diametrically opposite points corresponding to the at least one slot of the bottle thereby deforming the circular contour into an ovoid contour allowing the first and second snap engagement means to be unsecured from the grooves of the bottle which thereafter allows pulling the cap away from bottle. In some embodiments, the bottle has one circumferentially extending groove recessing from the exterior circumference of the bottle and one circumferentially extending shoulder outwardly protruding from the exterior circumference of the bottle where the groove and the shoulder are axially aligned to one another, with the groove being axially closer to the base than the shoulder. In some other embodiments, the bottle has two or more circumferentially extending and spaced-apart grooves recessing from the exterior circumference and two or more circumferentially extending and spaced-apart shoulders outwardly protruding from the exterior circumference. The grooves being axially closer to the base of the bottle than the shoulders and with each one of the grooves being circumferentially aligned with a corresponding one of the shoulders so as to define two or more circumferentially spaced-apart slots around the exterior circumference.

In accordance with another aspect, there is provided a bottle cap assembly comprising: a bottle having a base and a wall axially extending from a periphery of the base and leading to a neck finish, the neck finish having two circumferentially spaced-apart shoulders protruding from an exterior circumference of the neck finish, and two circumferentially spaced-apart grooves recessing from the exterior circumference, the two grooves being axially closer to the base than the two shoulders, each groove being circumferentially aligned with a corresponding one of the two shoulders so as to define two diametrically opposite slots around the exterior circumference; and a cap having a top and a wall axially extending from a periphery of the top and leading to a circular contour, the cap having first and second snap engagement means protruding inwardly from an interior circumference of the wall in proximity to the circular contour, the second snap engagement means having at least two snap engagement members being diametrically opposite to one another around the interior circumference, the cap being snappingly engageable to the bottle by forcing the first and second snap engagement means of the cap over the two shoulders so as to secure at least the first snap engagement means in the grooves of the bottle, and the cap being disengageable from the bottle by squeezing the cap at two diametrically opposite points corresponding to the two diametrically opposite slots of the bottle thereby deforming the circular contour into an ovoid contour allowing the first and second snap engagement means to be unsecured from the grooves of the bottle which thereafter allows pulling the cap away from bottle. In some embodiments, the first snap engagements means have a first radial protrusion length whereas the second snap engagements means have a second radial protrusion length exceeding the first protrusion length. However, in some other embodiments, the first and second protrusion lengths can be equivalent to one another. In still other embodiments, the first protrusion length may exceed the second protrusion length.

In accordance with another aspect, there is provided a bottle cap assembly comprising: a bottle having a base and a wall axially extending from a periphery of the base and leading to a neck finish, the neck finish having two circumferentially spaced-apart shoulders protruding from an exterior circumference of the neck finish, and two circumferentially spaced-apart grooves recessing from the exterior circumference, the two grooves being axially closer to the base than the two shoulders, each groove being circumferentially aligned with a corresponding one of the two shoulders so as to define two diametrically opposite slots around the exterior circumference; and a cap having a top and a wall axially extending from a periphery of the top and leading to a circular contour, the cap having snap engagement means protruding inwardly from an interior circumference of the wall in proximity to the circular contour, the cap being snappingly engageable to the bottle by forcing the snap engagement means of the cap over the two shoulders so as to secure at least the snap engagement means in the grooves of the bottle, and the cap being disengageable from the bottle by squeezing the cap at two diametrically opposite points corresponding to the two diametrically opposite slots of the bottle thereby deforming the circular contour into an ovoid contour allowing the snap engagement means to be unsecured from the grooves of the bottle which thereafter allows pulling the cap away from bottle. In some embodiments, the snap engagements means have first and second engagements means whereas the first snap engagements means have a first radial protrusion length and the second snap engagements means have a second radial protrusion length exceeding the first protrusion length. However, in some other embodiments, the first and second protrusion lengths can be equivalent to one another. In still other embodiments, the first protrusion length may exceed the second protrusion length. In some embodiments, the first engagement members can be omitted. In some other embodiments, the second engagement means can be omitted.

In accordance with another aspect, there is provided a bottle cap assembly comprising: a bottle having a base and a wall axially extending from a periphery of the base and leading to a neck finish, the neck finish having at least one circumferentially extending shoulder protruding from an exterior circumference of the neck finish, and at least one circumferentially extending groove recessing from the exterior circumference, the at least one groove being axially closer to the base than the at least one shoulder, the at least one groove being circumferentially aligned with a corresponding one of the at least one shoulder so as to define at least one circumferentially extending slot around the exterior circumference; and a cap having a top and a wall axially extending from a periphery of the top and leading to a circular contour, the cap having snap engagement means protruding inwardly from an interior circumference of the wall in proximity to the circular contour, the cap being snappingly engageable to the bottle by forcing the snap engagement means of the cap over the at least one shoulder so as to secure at least the snap engagement means in the grooves of the bottle, and the cap being disengageable from the bottle by squeezing the cap at two diametrically opposite points corresponding of the at least one slot of the bottle thereby deforming the circular contour into an ovoid contour allowing the snap engagement means to be unsecured from the grooves of the bottle which thereafter allows pulling the cap away from bottle. In some embodiments, the neck finish can have at least two circumferentially spaced-apart shoulders around the exterior circumference of the neck finish. In some embodiments, the neck finish can have at least two circumferentially spaced-apart grooves recessing from the exterior circumference of the neck finish. In these embodiments, the grooves are below the shoulders, and are circumferentially aligned with one another. In embodiments where only one groove and only one shoulder is provided, the rest of the circumference of the neck finish can act as a slot. In some embodiments, the snap engagements means have first and second engagements means whereas the first snap engagements means have a first radial protrusion length and the second snap engagements means have a second radial protrusion length exceeding the first protrusion length. However, in some other embodiments, the first and second protrusion lengths can be equivalent to one another. In still other embodiments, the first protrusion length may exceed the second protrusion length. In some embodiments, the first engagement members can be omitted. In some other embodiments, the second engagement means can be omitted.

Many further features and combinations thereof concerning the present improvements will appear to those skilled in the art following a reading of the instant disclosure.

DESCRIPTION OF THE FIGURES

In the figures.

DETAILED DESCRIPTION

Figure 1:
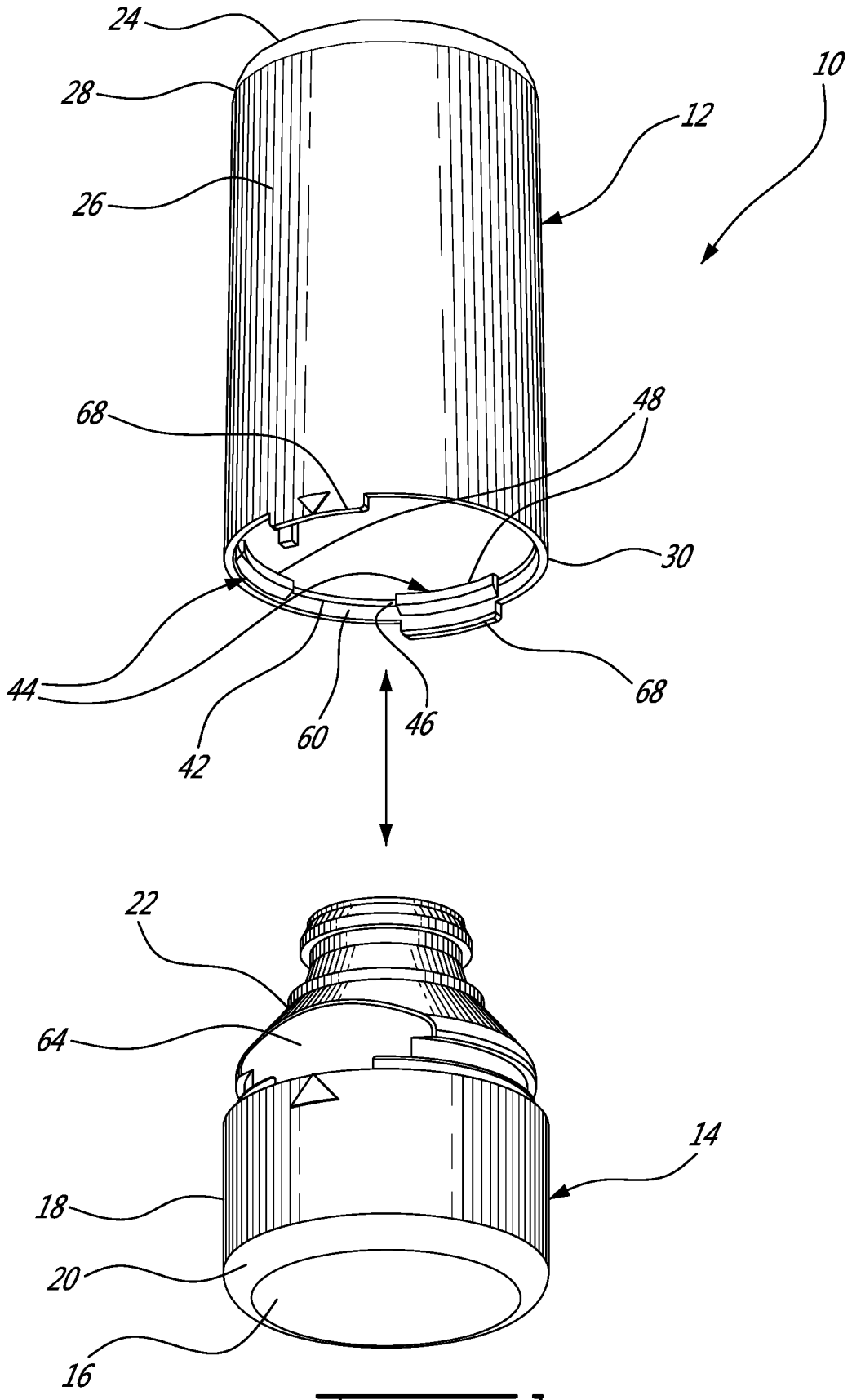
FIG. 1 is an exploded view of an example of a bottle cap assembly including a bottle and a cap, in accordance with one or more embodiments.

FIG. 1 shows an example of a bottle cap assembly 10 having a cap 12 which is snappingly engageable to a bottle 14. As can be understood, the cap 12 and the bottle 14 can be sized and shaped to accommodate different volumes of fluid. For instance, in some embodiments, the bottle 14 is sized and shaped to receive 15 mL of fluid, 20 mL of fluid, 30 mL of fluid and the like. The bottle 14 can be sized and shaped to receive other volumes of fluid in some other embodiments.

As depicted, the bottle 14 has a base 16 and a wall 18 axially extending from a periphery 20 of the base 16 and leading to a neck finish 22. Also shown, the cap 12 has a top 24 and a wall 26 axially extending from a periphery 28 of the top 24 and leading to a circular contour 30.

Figure 2B:
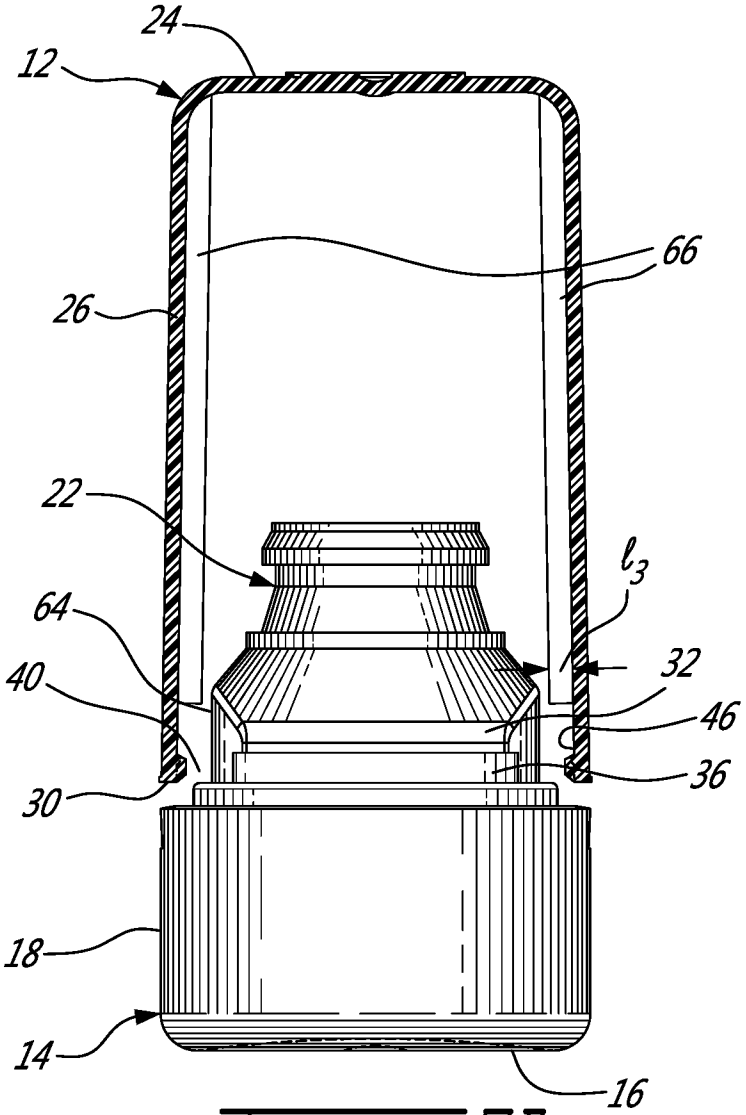
FIGS. 2A and 2B are sectional views of the bottle cap assembly of FIG. 1, showing the cap being snappingly engaged to the bottle and shown at rest, in accordance with one or more embodiments.
Figure 2A:
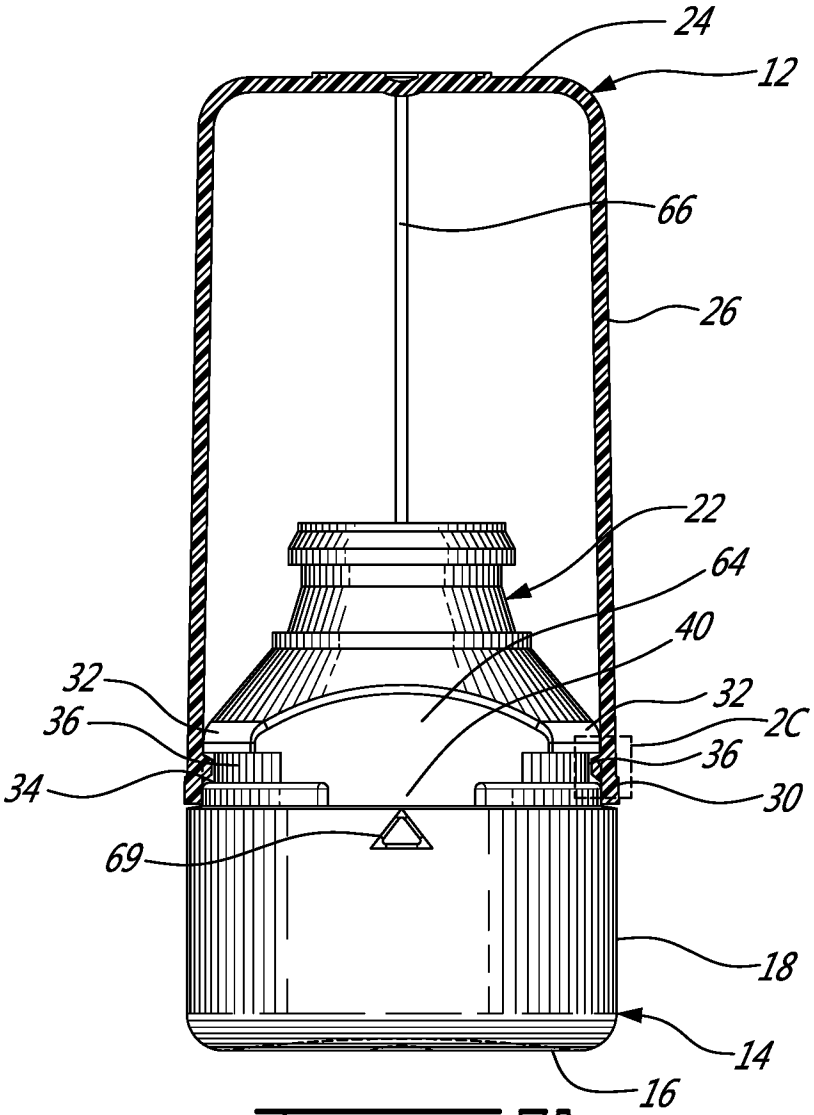

Referring now more specifically to FIGS. 2A and 2B, the neck finish 22 has two circumferentially spaced-apart shoulders 32 protruding from an exterior circumference 34 of the neck finish 22 in this example. As depicted, the neck finish 22 also has two circumferentially spaced-apart grooves 36 recessing from the exterior circumference 34. As shown, the two grooves 36 are axially closer to the base 16 than the two shoulders 32. In this example, each groove 36 is circumferentially aligned with a corresponding one of the two shoulders 32 so as to define two diametrically opposite slots 40 around the exterior circumference 34.

Figure 2C:
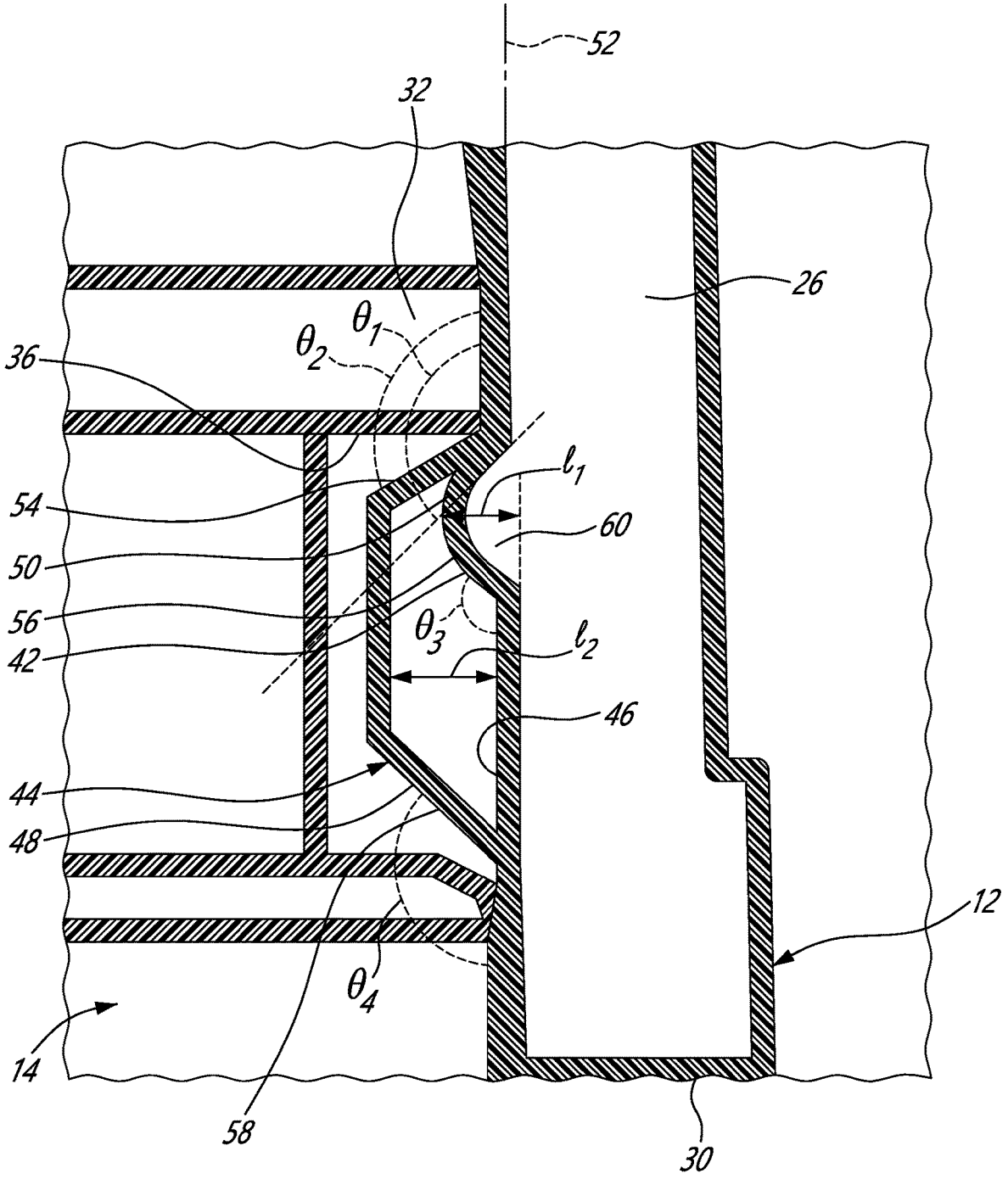
FIG. 2C is an enlarged view of a portion of FIG. 2A, showing examples of first and second snap engagement means of the cap.

As shown in FIGS. 1, 2A and 2B, and as best seen in FIG. 2C, the cap 12 has first and second snap engagement means 42 and 44 protruding inwardly from an interior circumference 46 of the wall 26. In this example, the first and second snap engagement means 42 and 44 are in proximity to the circular contour 30. The first snap engagement means 42 has a first radial protrusion length $l_1$. The second snap engagement means 44 has at least two snap engagement members 48 which are diametrically opposite to one another around the interior circumference 46. For instance, in the embodiment shown in FIGS. 1, 2A and 2B, there are four snap engagement members 48 which are evenly distributed around the interior circumference 46 of the cap 12 at ninety degrees from one another around the interior circumference 46.

As shown, the snap engagement members 48 each have a second radial protrusion length $l_2$ exceeding the first protrusion length $l_1$. In this way, the snapping engagement provided by the first snap engagement means 42 can be a little bit less aggressive, thereby providing a weaker engagement, than the snapping engagement provided by the second snap engagement means 44.

In this specific embodiment, the first snap engagement means 42 has a first retainer surface 50 facing the top 24 with a first angle $\theta_1$ relative to an axial orientation 52 whereas the snap engagement members 48 have corresponding second retainer surfaces 54 facing the top 24 with a second angle $\theta_2$ relative to the axial orientation 52. In this case, the first angle $\theta_1$ of the first retainer surface 50 is greater than the second angle $\theta_2$ of the second retainer surfaces 54. The first and second retainer surfaces 50 and 54 contribute to retaining the cap engaged to the bottle 14 if the cap 12 is accidentally pulled away from the bottle 14.

In this embodiment, the first angle $\theta_1$ is about 135° whereas the second angle second angle $\theta_2$ is about 115°. However, in some other embodiments, the first and second angles $\theta_1$ and $\theta_2$ can be different. For instance, the first angle $\theta_1$ ranges between about 110° and about 160°, preferably between about 115° and about 155°, and most preferably between about 120° and 150°. The second angle $\theta_2$ can range between about 90° and about 130°, preferably between about 95° and about 125°, and most preferably between about 100° and 120°.

Due to the shape of the first and second snap engagement means 42 and 44, in some embodiments, the strength of the engagement between the cap 12 and the bottle 14 can include a greater contribution from the second snap engagement means 44 than from the first snap engagement means 42.

As shown, the first snap engagement means 42 has a first snap surface 56 facing away from the top 24 with a third angle $\theta_3$ relative to the axial orientation 52 whereas the snap engagement members 48 have corresponding second snap surfaces 58 facing way from the top 24 with a fourth angle $\theta_4$ relative to the axial orientation 52. In this case, the fourth angle $\theta_4$ of the second retainer surfaces 58 is greater than the third angle $\theta_3$ of the second snap surface 56.

In this embodiment, the third angle $\theta_3$ is about 125° whereas the fourth angle second angle $\theta_4$ is about 130°. However, in some other embodiments, the third and fourth angles $\theta_3$ and $\theta_4$ can be different. For instance, the third angle $\theta_3$ ranges between about 100° and about 150°, preferably between about 105° and about 145°, and most preferably between about 110° and 140°. The fourth angle $\theta_4$ can range between about 105° and about 155°, preferably between about 110° and about 150°, and most preferably between about 105° and 140°.

In this example, the first snap engagement means 42 includes an annular member 60 inwardly protruding from the interior circumference 46 of the cap. Accordingly, notwithstanding the rotational position of the cap 12 relative to the bottle 14, there is at least a portion of the annular member 60 which is snappingly engaged with the grooves 36 of the bottle 14, to provide said engagement.

However, in some other embodiments, the first snap engagement means 42 can alternately include a plurality of spaced-apart protrusions inwardly protruding from the interior circumference 46 and being circumferentially spaced apart along the interior circumference 46 of the wall 26. Still, in other embodiments, the first snap engagement means 42 can be different.

It is intended that the cap 12 can be snappingly engageable to the bottle 14 by forcing the first and second snap engagement means 42 and 44 of the cap 12 over the two shoulders 32 so as to snugly secure at least the first snap engagement means 42 in the grooves 36 of the bottle 14, as depicted in FIGS. 2A, 2B and 2C.

Figure 3B:
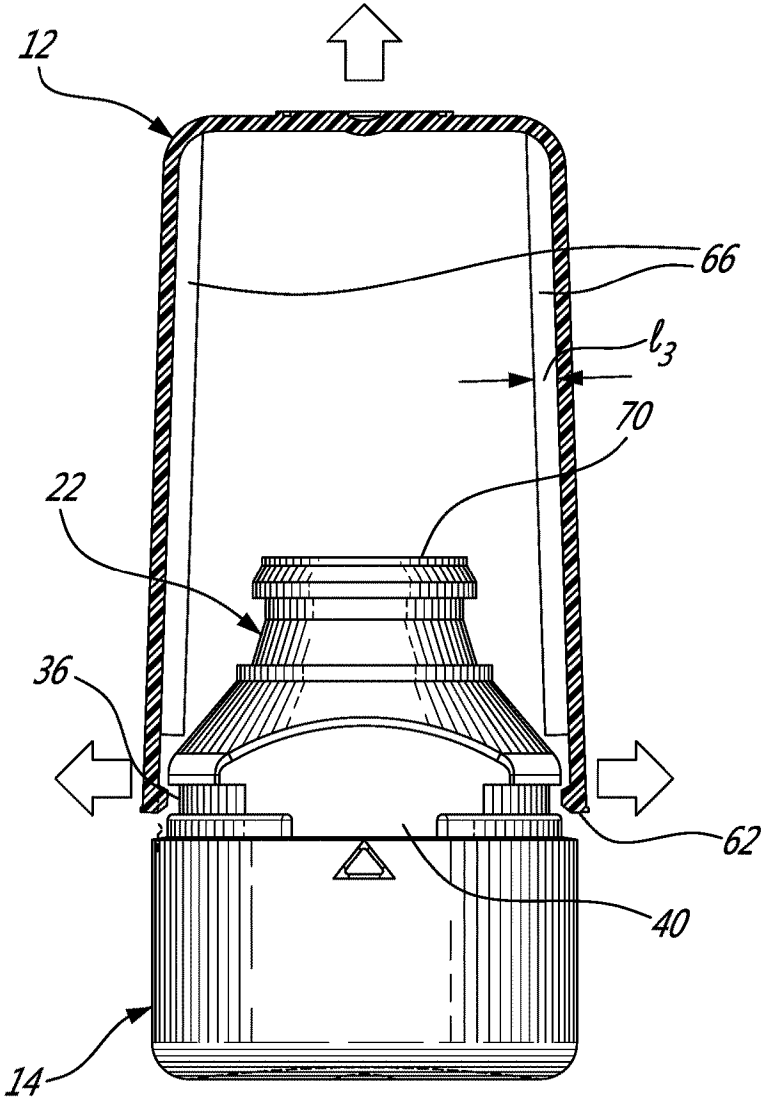
FIGS. 3A and 3B are sectional views of another example of a bottle cap assembly, showing the cap being snappingly engaged to the bottle and shown squeezed, in accordance with one or more embodiments.
Figure 3A:
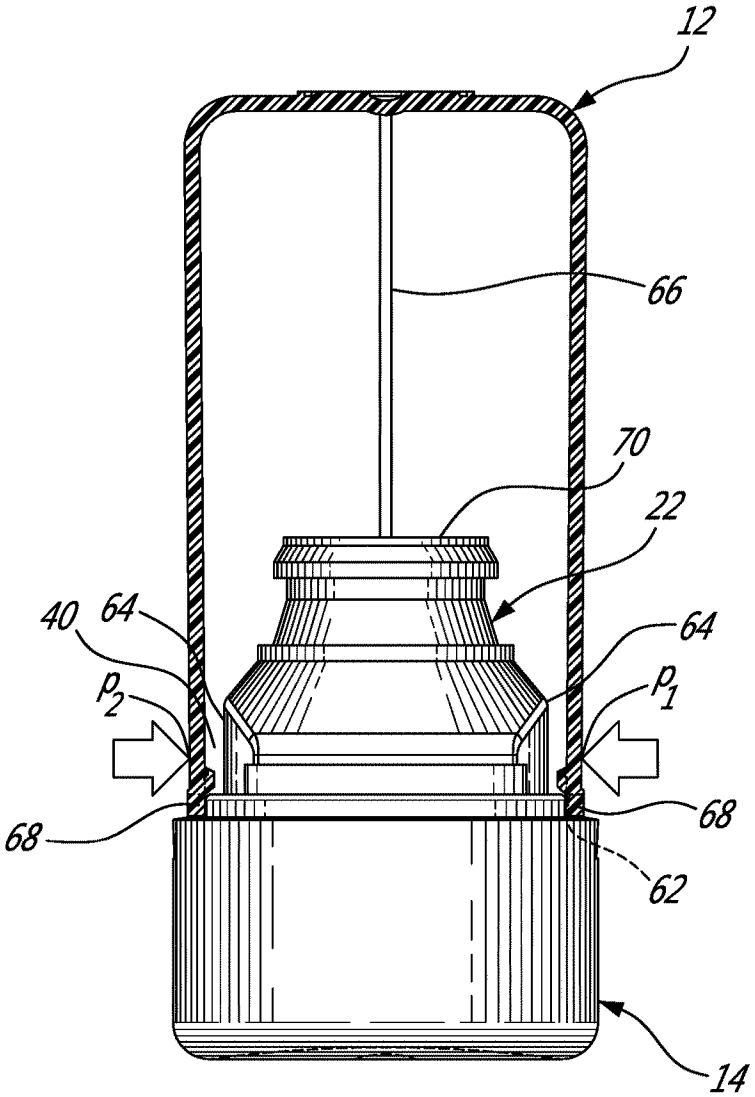
Figure 4A:
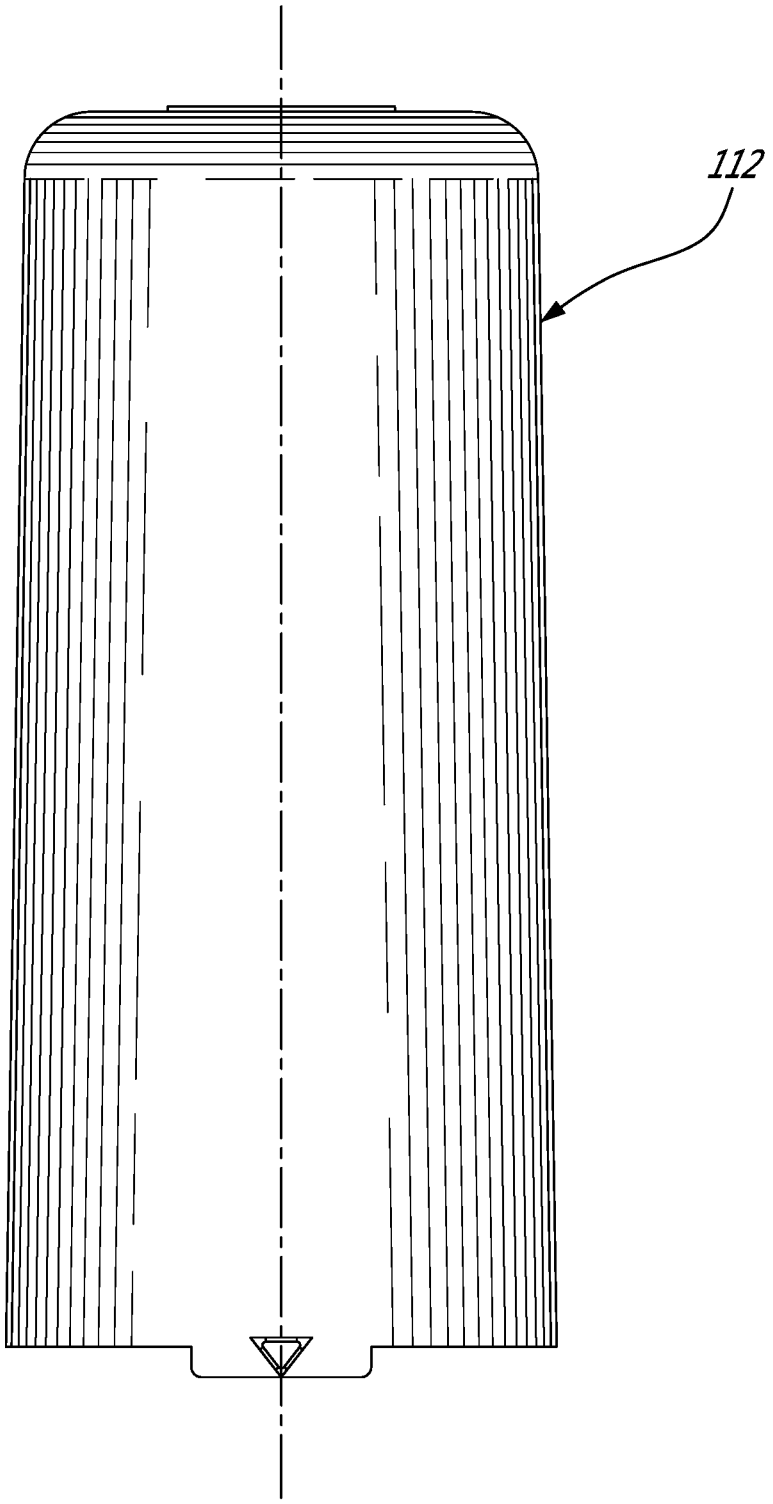
FIG. 4A is a side elevation view of another example of a cap, in accordance with one or more embodiments.
Figure 4B:
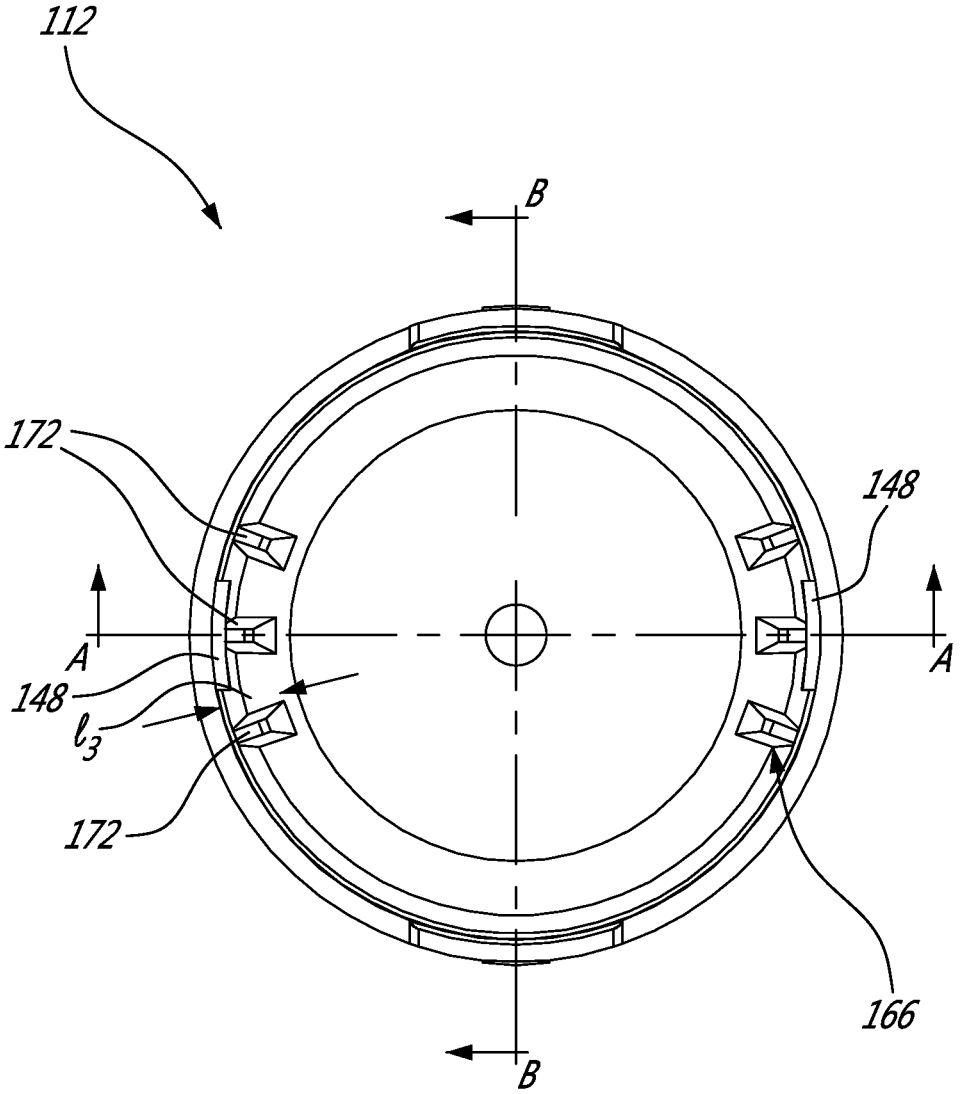
FIG. 4B is a bottom plan view of the cap of FIG. 4A.
Figure 4C:
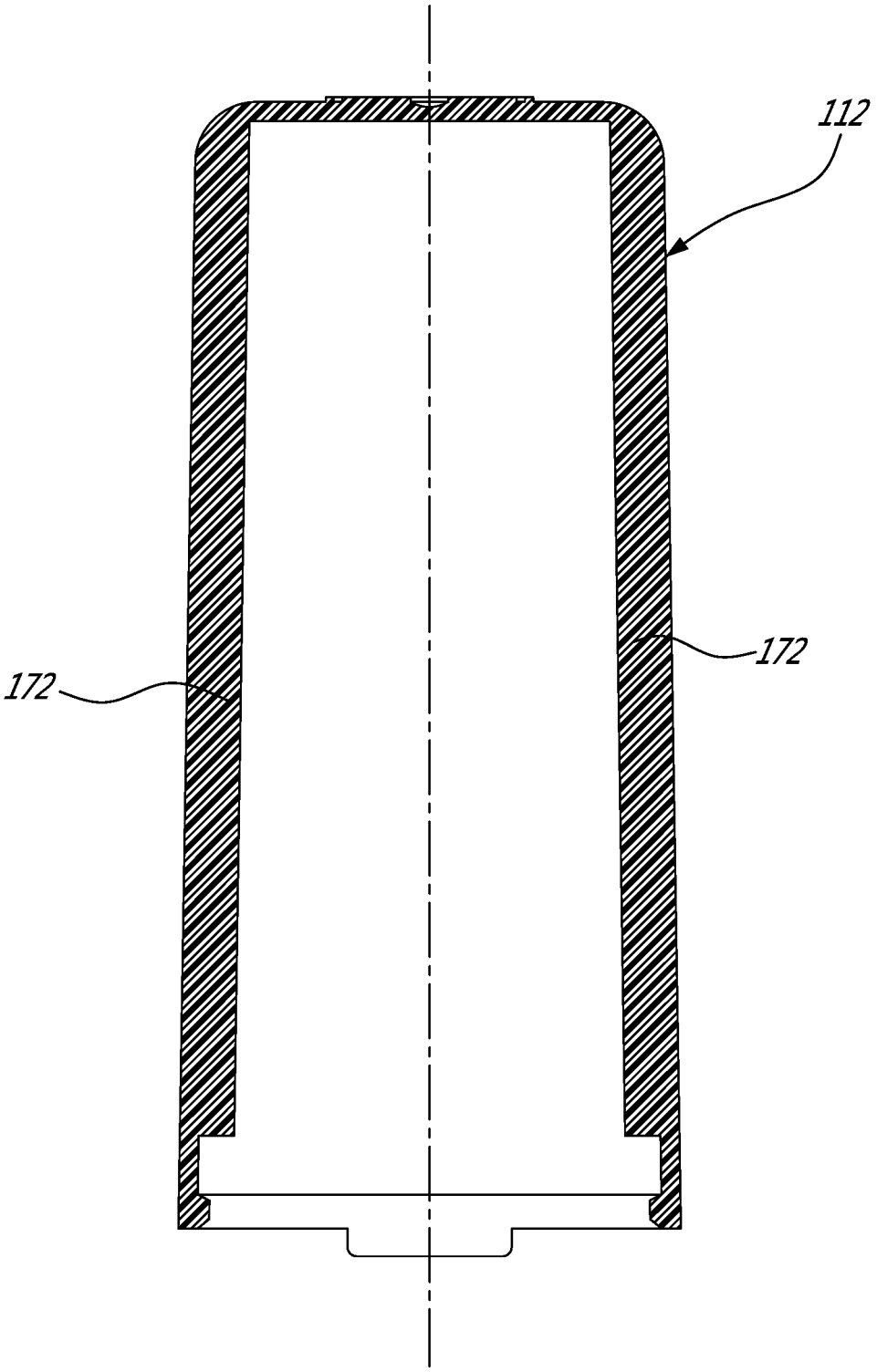
FIG. 4C is a sectional view of the cap of FIG. 4A, taken along line A-A of FIG. 4B.
Figure 4D:
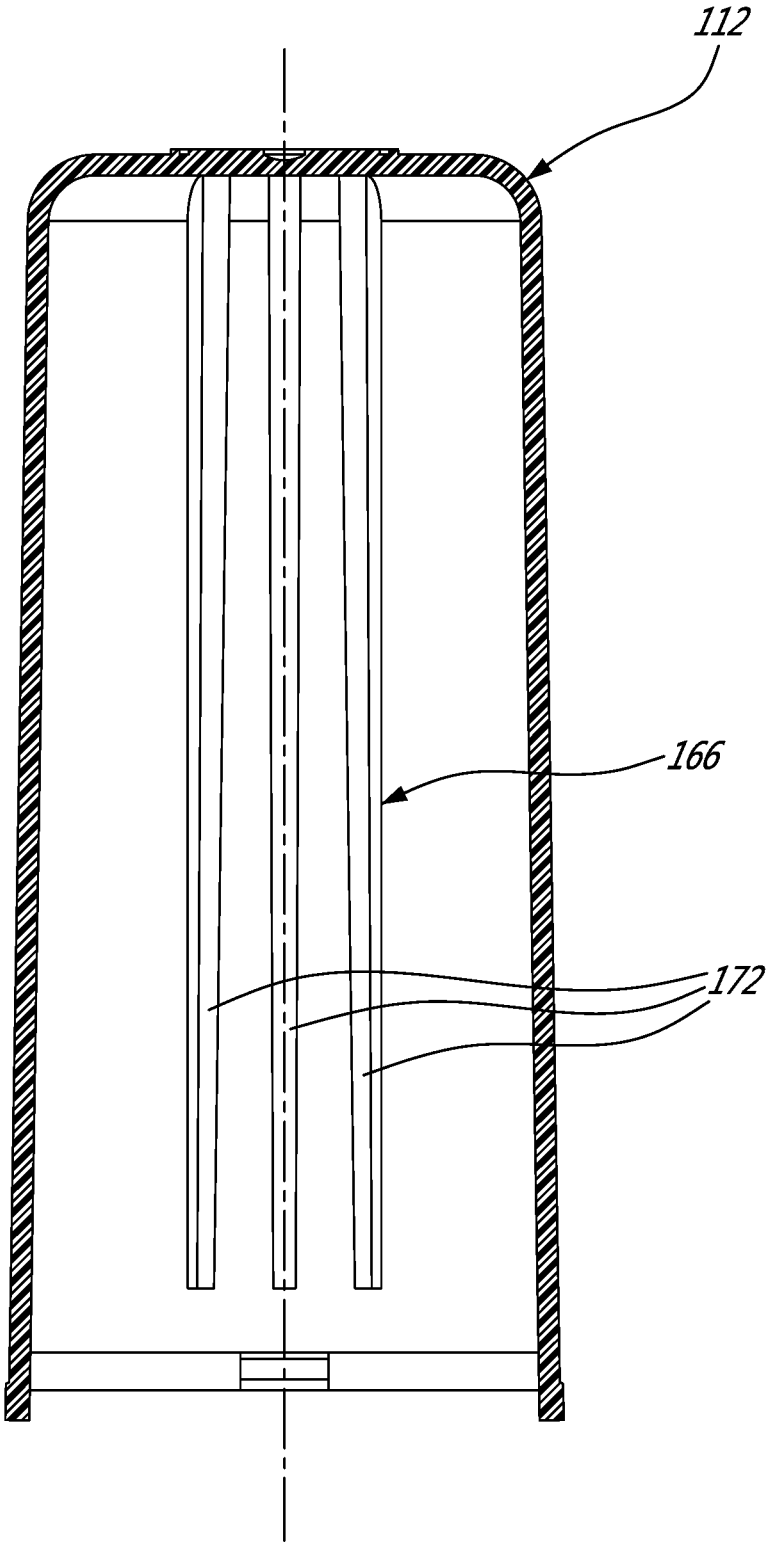
FIG. 4D is a sectional view of the cap of FIG. 4A, taken along line B-B of FIG. 4B.
Figure 5A:
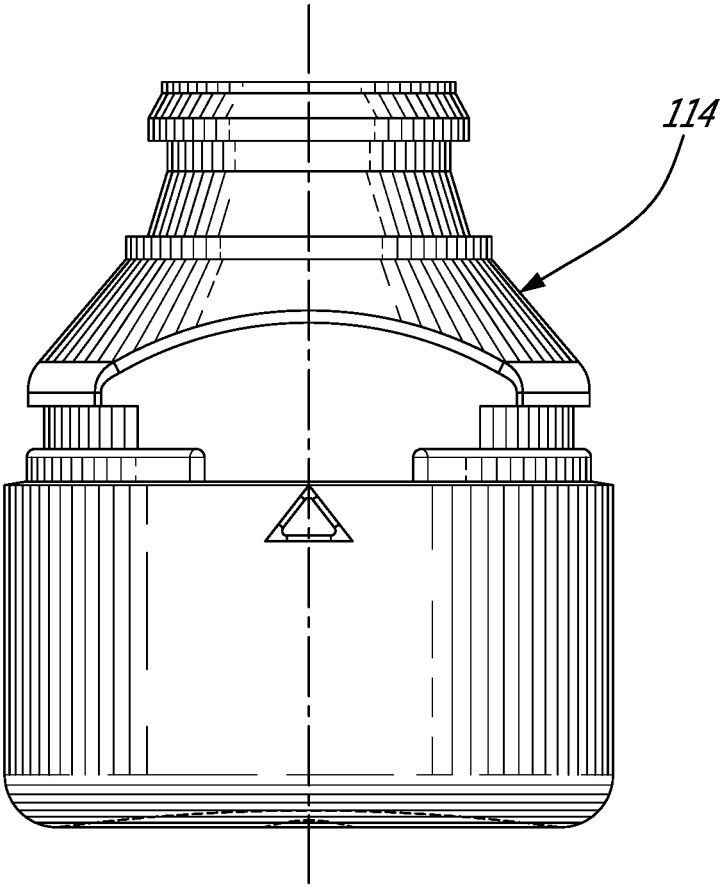
FIG. 5A is a side elevation view of another example of a bottle, in accordance with one or more embodiments.
Figure 5B:
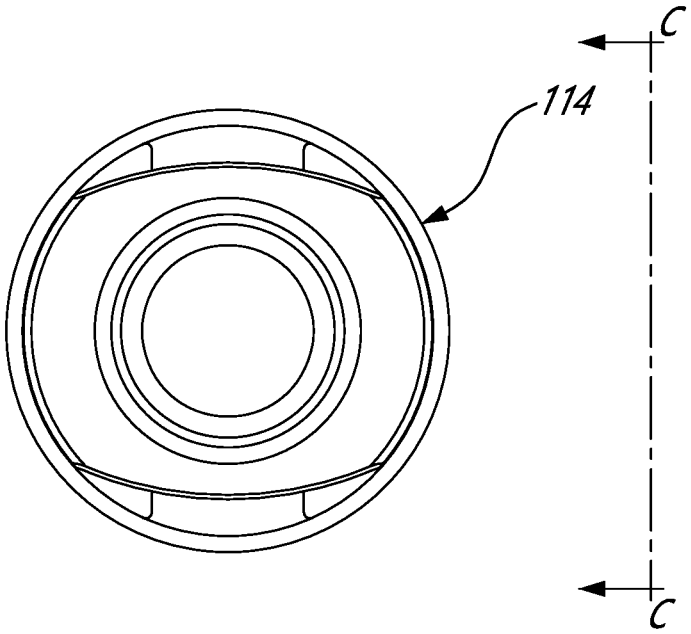
FIG. 5B is a top plan view of the bottle of FIG. 5A.
Figure 5C:
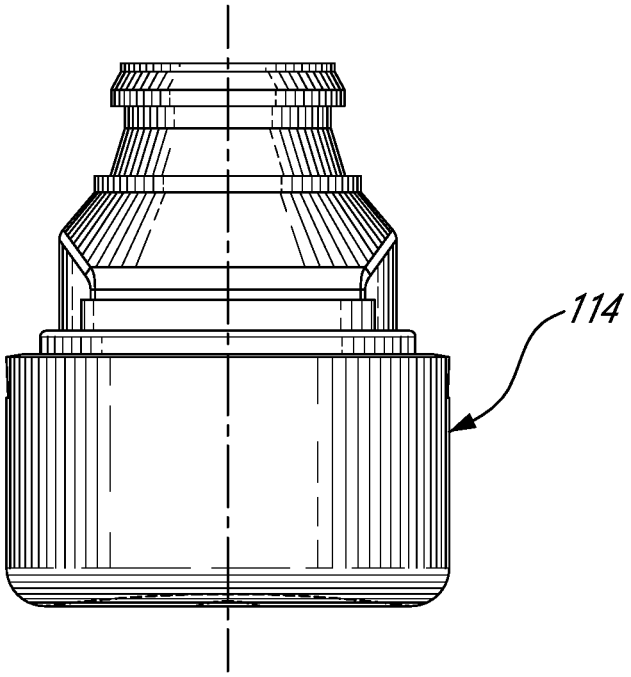
FIG. 5C is a side elevation view of the bottle of FIG. 5A, view from line C-C of FIG. 5B.

In this specific embodiment, the cap 12 can be disengaged from the bottle 14 by squeezing the cap 12 at two diametrically opposite points $P_1$ and $P_2$ corresponding to the two diametrically opposite slots 40 of the bottle 14 thereby deforming the circular contour 30 into an ovoid contour 62 allowing the first and second snap engagement means 42 and 44 to be unsecured from the grooves 36 of the bottle 14 which thereafter allows pulling the cap 12 away from bottle 14, as illustrated in FIGS. 3A and 3B.

In this specific example, the neck finish 22 includes two abutment surfaces 64 extending axially at a corresponding one of the two slots 40. Moreover, the cap 12 can have two diametrically opposite stopper members 66 inwardly protruding from the interior circumference 46 of the wall 26 farther to the circular contour 30 than the first and second snap engagement means 42 and 44. The stopper members 66 can have a third radial protrusion length $l_3$ which is greater than the first and second protrusion lengths $l_1$ and $l_2$. Accordingly, in this specific example, the cap 12 can be disengaged from the bottle 14 by, prior to said squeezing, rotating the cap 12 and the bottle 14 relative to one another such that the stopper members 66 are put away from the abutment surfaces 64, such as shown in FIGS. 3A and 3B. In this specific position, an abutment between the stopper members 66 and corresponding ones of the corresponding abutment surfaces 64 can prevent the deformation of the circular contour 30 (see FIG. 2B).

As depicted, in this example, the circular contour 30 of the cap 12 has one or more tabs 68 axially protruding away from the circular contour 30. In this example, the circular contour 30 of the cap 12 has two tabs 68 which are circumferentially interspersed with corresponding ones of the stopper members 66. In this way, to disengage the cap 12 from the bottle 14, rotation of the cap 12 and the bottle 14 relative to one another so as to circumferentially align the tabs 68 with corresponding slots 40 of the bottle 14 is required prior to said squeezing and pulling, which can thereby circumferentially misalign the two stopper members 66 from the slots 40 of the bottle 14. One or more alignment indicia 69 can be provided on the wall 18 of the bottle 14 to help in the circumferential alignment of the tabs 68.

As can be understood, the neck finish 22 typically ends in an opening 70 to receive fluid. For instance, in some embodiments, the neck finish 22 is adapted to receive a fluid distributor mechanism such as a nasal fluid spray. In some embodiments, the opening 70 is sealed using a sealing membrane or using a twist cap. In these embodiments, the cap 12 is sized and shaped so as to enclose the fluid distributor mechanism, the sealing membrane, the twist cap or any other device to seal and/or distribute the fluid contained in the bottle 14.

FIGS. 4A to 5C show different views of another example of a bottle cap assembly including cap 112 and bottle 114. As best shown in FIG. 4B, the cap 112 includes two snap engagement members 148 which inwardly protrude from the interior circumference of the cap 112 instead of four snap engagement members. Also, the stopper members 166 of this example each includes a set of three circumferentially spaced-apart stopper member sibs 172.

Figure 6:
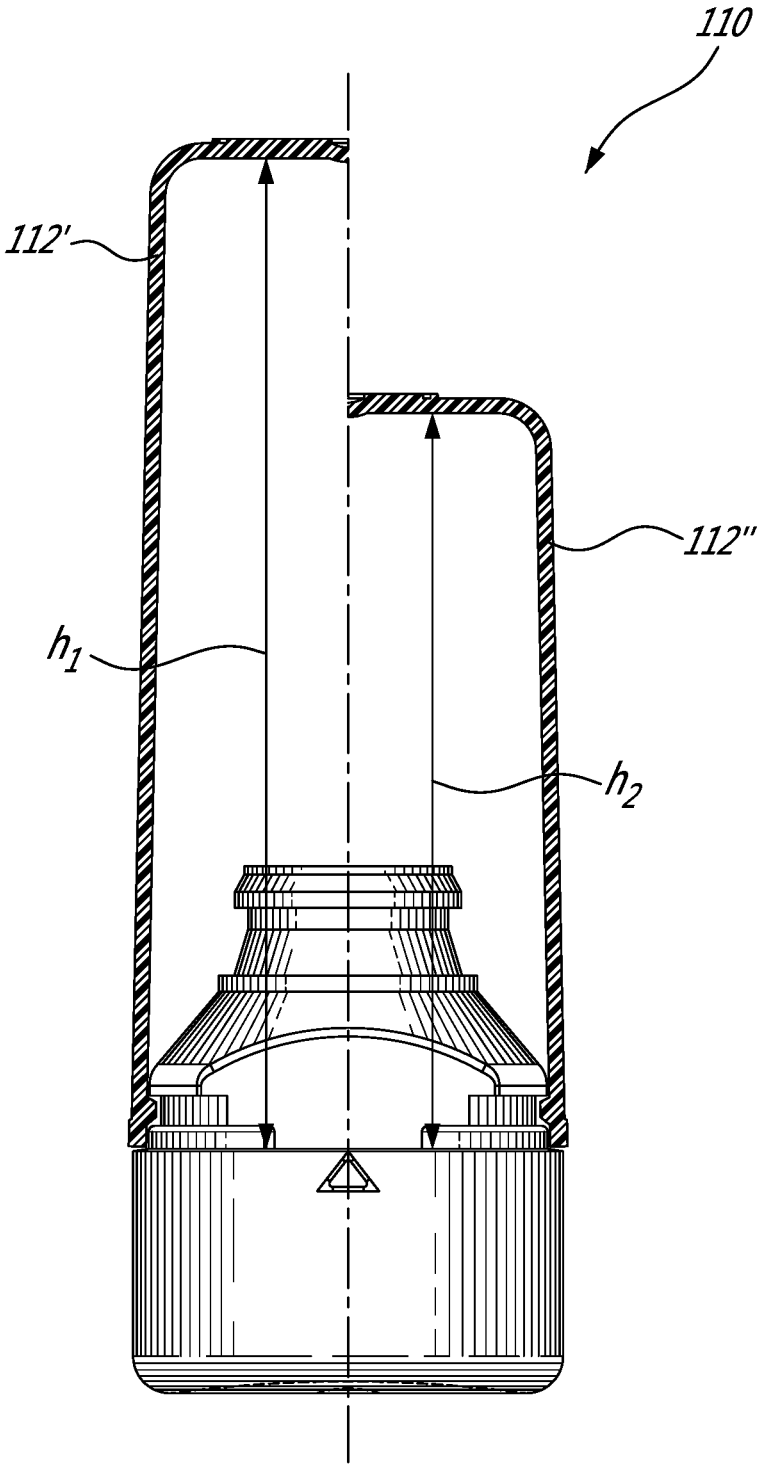
FIG. 6 is another example of a bottle cap assembly, showing cap with different heights, in accordance with one or more embodiments.

FIG. 6 shows another example of a bottle cap assembly 110, with caps 112' and 112" having different heights $h_1$ and $h_2$.

Figure 7A:
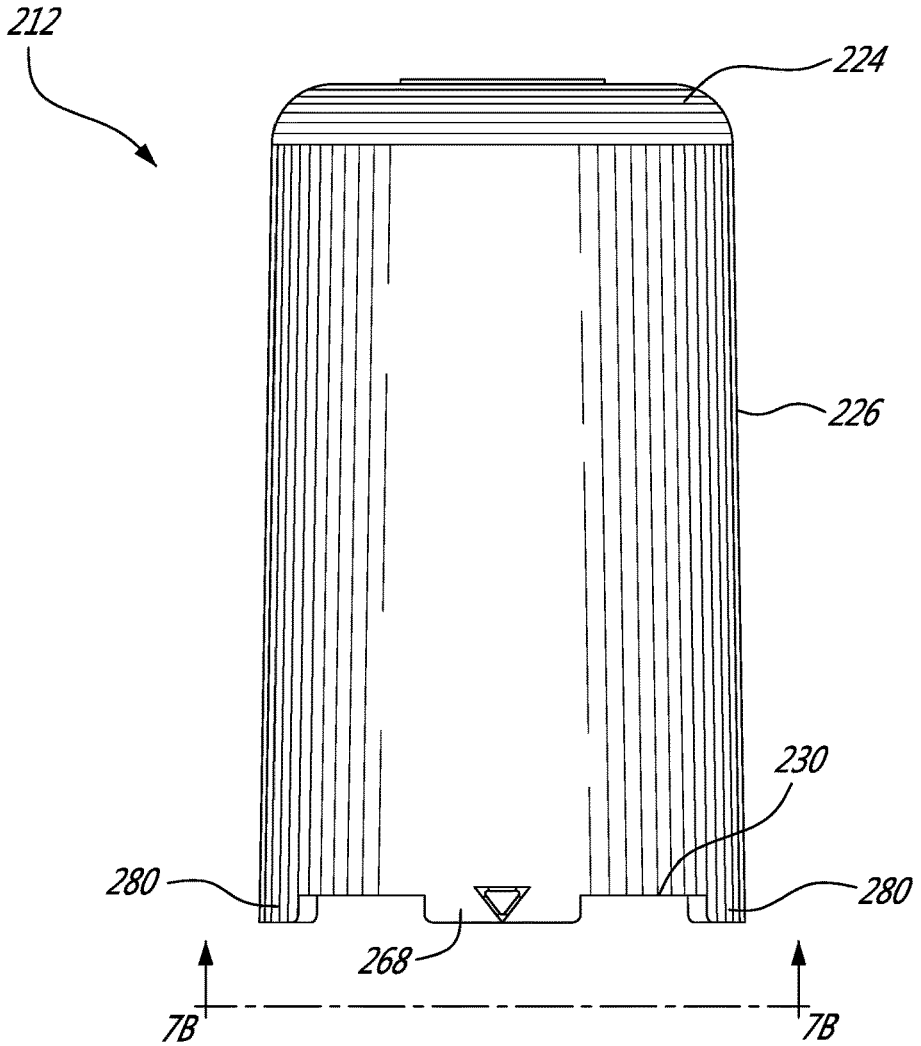
FIG. 7A is a side elevation view of another example of a cap, showing primary tabs and auxiliary tabs, in accordance with one or more embodiments.
Figure 7B:
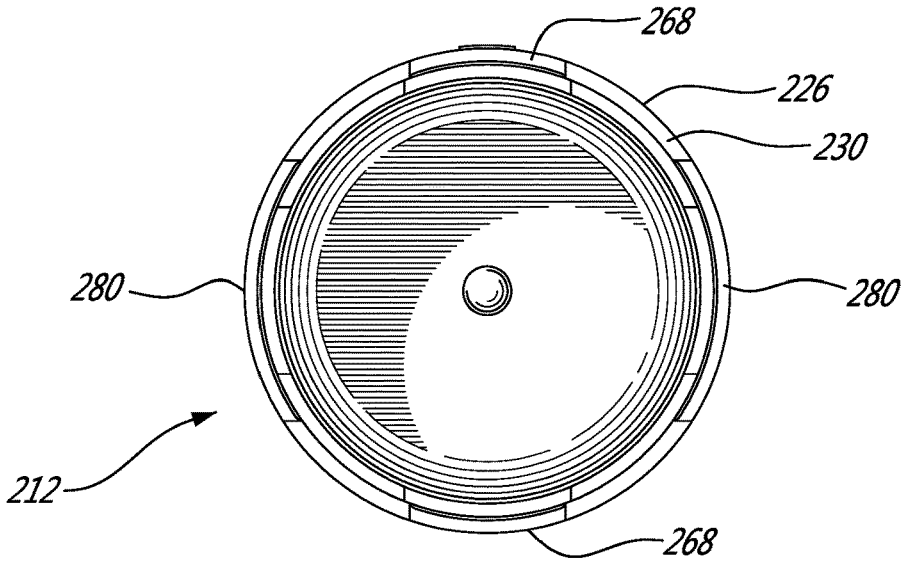
FIG. 7B is a bottom plan view of the cap of FIG. 7A, view from line 7B-7B of FIG. 7A.
Figure 7C:
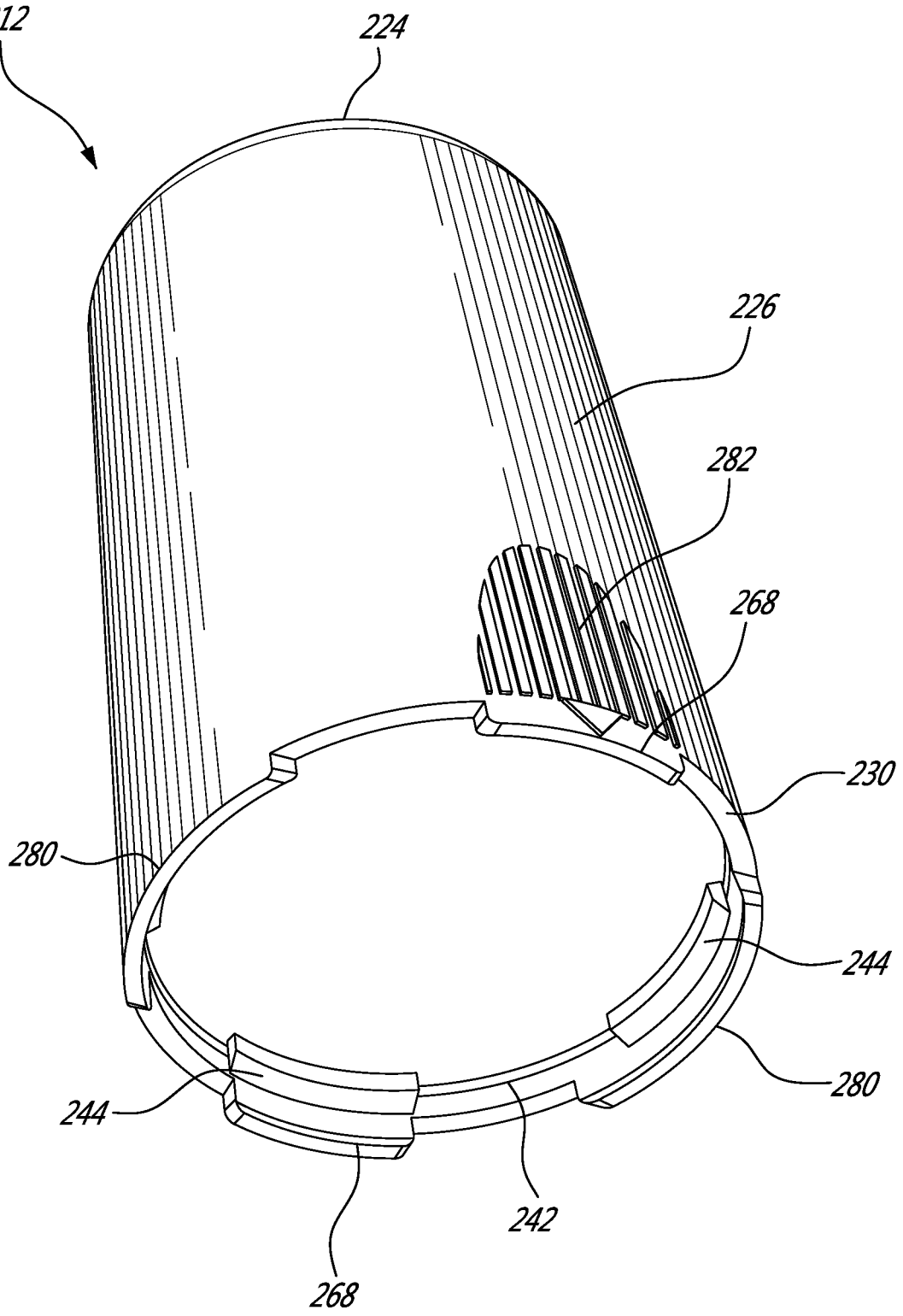
FIG. 7C is an oblique view of the cap of FIG. 7A.

FIGS. 7A, 7B and 7C show another example of a cap 212, in accordance with one or more embodiments. As depicted, the cap 212 has a top 224 and a wall 226 which axially extends from a periphery of the top 224 and which leads to a circular contour 230. Similarly as described above, the cap 212 has first and second snap engagement means 242 and 244 which protrude inwardly from an interior circumference of the wall 226 in proximity to the circular contour 230. As shown in this specific example, the circular contour 230 has a plurality of tabs each axially protruding away therefrom. More specifically, the circular contour 230 has a pair of primary tabs 268 which are diametrically opposite from one another around the circular contour 230. Moreover, in this example, the circular contour 230 has a pair of auxiliary tabs 280 which are diametrically opposite from one another around the circular contour 230 and interspersed with the primary tabs 268. It was found that the use of the auxiliary tabs 280, and corresponding second engagement means 244, can improve the child-resistance of the resulting bottle cap assembly. Moreover, when the cap 212 is engaged to a bottle, the snug engagement of the auxiliary tabs 280 with the base of the neck finish of the bottle can advantageously prevent the cap 212 from being tilted laterally during use, which may have been seen as an inconvenience. Also shown in this embodiment are texture members 282 positioned proximate the primary tabs 268. It was found that, at least in some situations, such texture members 282 can help elders find where the cap 212 has to be pressed to deform, and then allow disengagement between the cap 212 and the corresponding bottle. However, in some other embodiments, the texture members are omitted.

As can be understood, the examples described above and illustrated are intended to be exemplary only. For instance, although the bottle cap assemblies discussed above includes two grooves and shoulders, there can be bottle cap assemblies including more than two grooves and more than two shoulders in alternate embodiments. The bottle and/or the cap can be made of high-density polyethylene (HDPE) or any other suitable material. The bottle cap assembly can have a weight of about 7.5 grams and can be molded using extrusion blow molding or any other suitable manufacturing technique. The term "circular contour" is used broadly so as to encompass shape which is not perfectly circular. In alternate embodiments, the stopper members of the cap are optional. The scope is indicated by the appended claims.

What is claimed is:

1. A bottle cap assembly comprising: a bottle having a base and a wall axially extending from a periphery of the base and leading to a neck finish, the neck finish having at least two circumferentially spaced-apart shoulders protruding from an exterior circumference of the neck finish, and at least two circumferentially spaced-apart grooves recessing from the exterior circumference, the grooves being axially closer to the base than the shoulders, each groove being circumferentially aligned with a corresponding one of the shoulders so as to define at least one pair of diametrically opposite slots around the exterior circumference; and a cap having a top and a wall axially extending from a periphery of the top and leading to a circular contour, the cap having first and second snap engagement means protruding inwardly from an interior circumference of the wall of the cap in proximity to the circular contour, the first snap engagement means having a first radial protrusion length, the second snap engagement means having at least one pair of snap engagement members being diametrically opposite to one another around the interior circumference, the at least one pair of snap engagement members having a second radial protrusion length exceeding the first radial protrusion length, the cap being snappingly engageable to the bottle by forcing the first and second snap engagement means of the cap over the shoulders so as to secure at least the first snap engagement means in the grooves of the bottle, and the cap being disengageable from the bottle by squeezing the cap at at least one pair of diametrically opposite points corresponding to the slots of the bottle thereby deforming the circular contour into an ovoid contour allowing the first and second snap engagement means to be unsecured from the grooves of the bottle which thereafter allows pulling the cap away from bottle.

2. The bottle cap assembly of claim 1 wherein the neck finish of the bottle includes at least two abutment surfaces extending axially at a corresponding one of the slots, the cap having at least one pair of diametrically opposite stopper members inwardly protruding from the interior circumference of the wall of the cap farther from the circular contour than the first and second snap engagement means and having a third radial protrusion length being greater than the first and second radial protrusion lengths, the cap being disengageable from the bottle by, prior to said squeezing, rotating the cap and the bottle relative to one another such that the stopper members are put away from the abutment surfaces.

3. The bottle cap assembly of claim 2 wherein the circular contour of the cap has a pair of primary tabs which are diametrically opposite around the circular contour, the primary tabs being circumferentially interspersed with corresponding one of the stopper members, the cap being disengageable from the bottle by, prior to said squeezing, rotating the cap and the bottle relative to one another so as to circumferentially align the primary tabs with one of the slots of the bottle, thereby circumferentially misaligning the stopper members from said slots of the bottle.

4. The bottle cap assembly of claim 2 wherein the circular contour of the cap has a pair of auxiliary tabs which are diametrically opposite around the circular contour, the auxiliary tabs being circumferentially aligned with corresponding ones of the stopper members.

5. The bottle cap assembly of claim 1 wherein the circular contour of the cap has a plurality of tabs each axially protruding away from the circular contour.

6. The bottle cap assembly of claim 5 wherein the circular contour of the cap has a pair of primary tabs being diametrically opposite from one another around the circular contour.

7. The bottle cap assembly of claim 6 wherein the circular contour of the cap has a pair of auxiliary tabs being diametrically opposite from one another around the circular contour and interspersed with said primary tabs.

8. The bottle cap assembly of claim 1 wherein the first snap engagement means includes an annular member inwardly protruding from the interior circumference of the cap.

9. The bottle cap assembly of claim 1 wherein the first snap engagement means includes a plurality of spaced-apart protrusions inwardly protruding from the interior circumference and being circumferentially spaced apart along the interior circumference of the wall of the cap.

10. The bottle cap assembly of claim 1 wherein the first snap engagement means has a retainer surface facing the top with a first angle relative to an axial orientation and the snap engagement members having second retainer surfaces facing the top with a second angle relative to the axial orientation, the first angle being greater than the second angle.

11. The bottle cap assembly of claim 1 wherein the snap engagement members includes four snap engagement members being circumferentially spaced-apart from one another and being evenly distributed around the interior circumference of the cap.

12. The bottle cap assembly of claim 1 wherein the neck finish ends in an opening, the neck finish being also configured to receiving a fluid distributor member.

13. A method of disengaging a cap from a bottle, the bottle having a base and a wall axially extending from a periphery of the base and leading to a neck finish, the neck finish having at least two circumferentially spaced-apart shoulders protruding from an exterior circumference of the neck finish, and at least two circumferentially spaced-apart grooves recessing from the exterior circumference, the grooves being axially closer to the base than the shoulders, each groove being circumferentially aligned with a corresponding one of the shoulders so as to define at least one pair of diametrically opposite slots around the exterior circumference; and the cap having a top and a wall axially extending from a periphery of the top and leading to a circular contour, the cap having first and second snap engagement means protruding inwardly from an interior circumference of the wall of the cap in proximity to the circular contour, the first snap engagement means having a first radial protrusion length, the second snap engagement means having at least one pair of snap engagement members being diametrically opposite to one another around the interior circumference, the snap engagement members having a second radial protrusion length exceeding the first radial protrusion length, the method comprising:

squeezing the cap at at least one pair of diametrically opposite points corresponding to the slots of the bottle thereby deforming the circular contour into an ovoid contour allowing the first and second snap engagement means to be unsecured from the grooves of the bottle; and pulling the cap away from bottle.

14. The method of claim 13 wherein the neck finish of the bottle has at least two abutment surfaces extending axially at a corresponding one of the slots, the cap having at least two stopper members inwardly protruding from the interior circumference of the wall of the cap farther to from the circular contour than the first and second snap engagement means and having a third radial protrusion length being greater than the first and second radial protrusion lengths, the method further comprising:

prior to said squeezing, rotating the cap and the bottle relative to one another such that the stopper members are put away from the abutment surfaces.

* * * * *